United States Patent [19]

Brandli et al.

[11] 4,000,431

[45] Dec. 28, 1976

[54] ULTRAVIOLET RADIATION SOURCE WITH ENVELOPE HAVING PRESSURE EQUALIZATION REGION

[75] Inventors: Gerold Brandli, Aarau; Walter Stoidl, Gebenstorf, both of Switzerland

[73] Assignee: BBC Brown Boveri & Company Limited, Baden, Switzerland

[22] Filed: Mar. 1, 1976

[21] Appl. No.: 662,874

[30] Foreign Application Priority Data

Mar. 14, 1975 Switzerland ..... 3233/75

[52] U.S. Cl. ..... 313/185; 313/186; 313/204; 313/217; 313/220; 313/221; 313/225

[51] Int. Cl.[2] ..... H01J 61/067; H01J 61/20; H01J 61/24; H01J 61/30

[58] Field of Search ..... 313/185, 186, 220, 225, 313/228, 221, 217, 204

[56] References Cited

UNITED STATES PATENTS

| | | | |
|---|---|---|---|
| 3,117,248 | 1/1964 | Lake | 313/220 X |
| 3,689,793 | 9/1972 | Walz | 313/220 |
| 3,851,272 | 11/1974 | Shull et al. | 313/220 X |

*Primary Examiner*—Palmer C. Demeo
*Attorney, Agent, or Firm*—Oblon, Fisher, Spivak, McClelland & Maier

[57] ABSTRACT

A device for producing ultraviolet radiation of high spectral radiation intensity is disclosed in which the radiation is generated in a mercury-argon-filled discharge tube with a thermoemissive cathode by a wall-stabilized d.c. gas discharge at a mercury pressure $p_{Hg}$ between $5 \times 10^{-3}$ and $5 \times 10^{-1}$ torr, an argon pressure $p_{Ar}$ between 0.01 and 10 torr and a current density $j_o$ of the discharge current I between 1 and 25 A/cm$^2$, and in which the two electrode spaces are connected to one another through a pressure-equalization region as well as through the discharge region wherein the two electrodes are arranged in tandem in a common envelope, the two arms of the discharge region are joined to the end of the envelope nearest the discharge region so that one arm projects coaxially into the envelope and passes through the toroidal electrode nearest the discharge region, and the inner wall of the envelope and the arm projecting into the envelope are each provided with a collar between the two electrodes, the collars being so arranged with respect to one another as to form a connecting passage acting as a pressure-equalizing region running between the cathode and anode spaces with a first portion running in the cathode/anode direction and a second portion running in the anode/cathode direction.

5 Claims, 4 Drawing Figures

ULTRAVIOLET RADIATION SOURCE WITH ENVELOPE HAVING PRESSURE EQUALIZATION REGION

BACKGROUND OF THE INVENTION

The invention concerns a device for generating ultraviolet radiation with high spectral radiation density, the radiation being produced in a mercury/argon-filled discharge tube with a thermoemissive cathode by a wall-stabilized d.c. gas discharge at a mercury pressure $p_{Hg}$ between $5 \times 10^{-3}$ and $5 \times 10^{-1}$ torr, an argon pressure $P_{Ar}$ between 0.01 and 10 torr and a current density $j_o$ of the discharge current I between 1 and 25 A/cm$^2$, and the two electrode spaces being connected to one another by a pressure equalization space as well as by the discharge region.

Such a device — in short: high-current-low-pressure-UV-radiation source-was described in its essentials in main German patent PA 24 12 997.3 (copending U.S. Pat. application Ser. No. 551,425, filed Feb. 20, 1975) where the value of the discharge current I or the current density $j_o$ is adjusted to suit the material to be irradiated, and the mercury pressure is controlled by the mercury temperature in such a way that the yield of the line of wavelength 253.7 $\mu$m, i.e. the ratio of the radiation output at this wavelength to the electrical power input to the discharge, is at least 80% of the yield-maximum for the set current density $j_o$. The quantitative relationship between the set dischargecurrent density $j_o$ and the mercury temperature to be selected is detailed in the main patent.

In the practical form of embodiment given in the main patent the two electrodes, cathode and anode, are enclosed in separate envelopes, preferably of glass. This makes fabrication difficult and makes the device rather delicate for handling in industrial use. If the envelopes are located side-by-side, a more complicated, bulkier and more expensive holder becomes necessary. In certain installations, e.g. in packaging machines for sterile liquid filling in which filling is done through a tube, or in the sterilization of bottles, radiation sources with side-by-side electrode-space envelopes can be incorporated only with great difficulty.

SUMMARY OF THE INVENTION

It is an aim of the invention to overcome these disadvantages and to improve the radiation source of the main patent in such a way that it is, particularly in industrial use, resistant to handling and easy to install, while simultaneously being economical to produce in terms of cost and materials.

The foregoing and other objects are attained in accordance with one aspect of the present invention through the provision of a device of the aforementioned type by arranging the two electrodes in tandem in a common envelope, joining the two arms of the discharge space to the end of this envelope, making one of these arms coaxial and inserted into the envelope so as to pass through the toroidal electrode on the discharge end of the envelope, and providing collars on the inner wall of the envelope and on the arm projecting into the envelope, the collars being situated between the two electrodes in such a way that a connecting passage acting as a pressure-equalization space is formed between the cathode and anode spaces, a first portion of this passage running in the cathode/anode direction and a second portion running in the anode/cathode direction.

A UV-radiation source of such a design optimally satisfies the aforementioned requirements.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
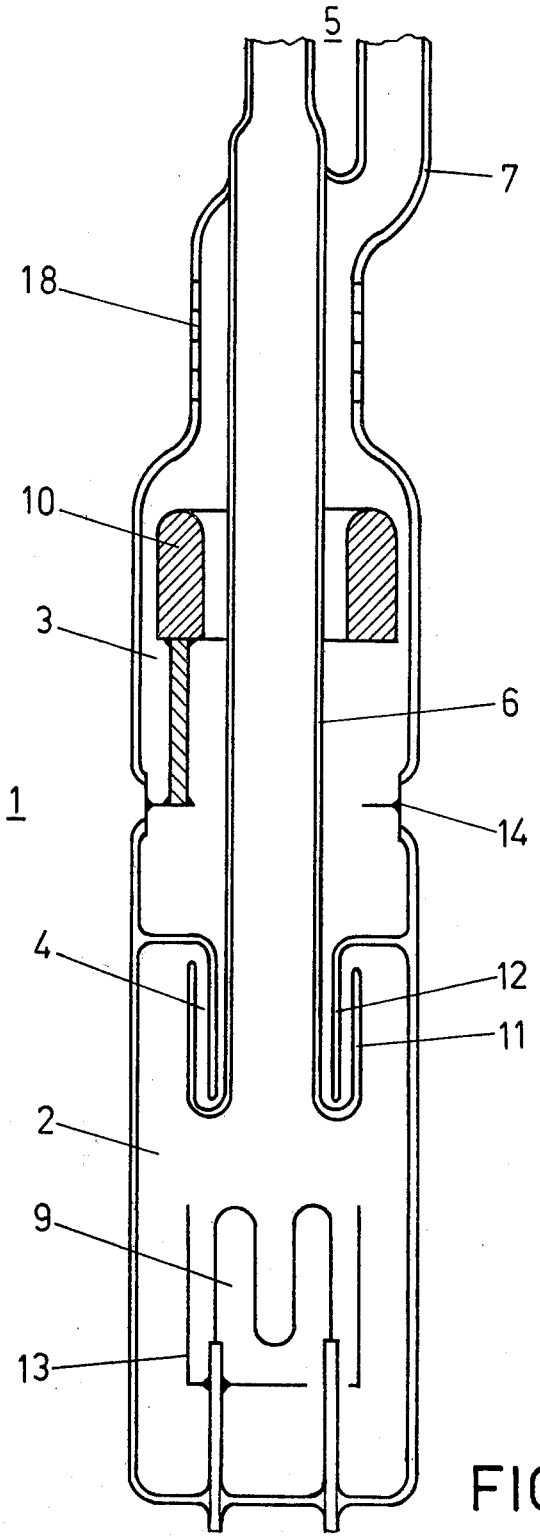
FIG. 1 shows the envelope of a radiation source conforming to the invention, proved in use, and having a toroidal anode, for a flat U- or meander-shaped or even a coiled discharge space.

Referring now to the drawings, wherein like reference numerals designate identical or corresponding parts throughout the several views, and more particularly to FIG. 1 thereof, in FIG. 1 is shown an envelope 1 essentially of heat-resistant glass in which the two electrodes, the cathode 9 and the anode 10, are arranged in tandem. As is also particularly apparent from FIG. 2, the discharge region 5 consists of two arms 6 and 7, which are both joined to the end of the envelope 1. Here the arm 6 projects coaxially into the envelope 1 and passes through the toroidal anode 10.

The arms 6 and 7 are of fused quartz or the like, so that the UV-radiation can get out. Because of the different thermal expansion coefficients of pyrex and fused quartz, the arm 7 is joined to the envelope 1 by a graded seal 18. For this a number of glass rings are fused together, the rings having thermal expansion coefficients graded between those of the pyrex and fused quartz. The arm 6 can then, according to the concept of the invention, be fused directly to the arm 7, so that a second graded seal to envelope 1 is unnecessary.

Figure 2:
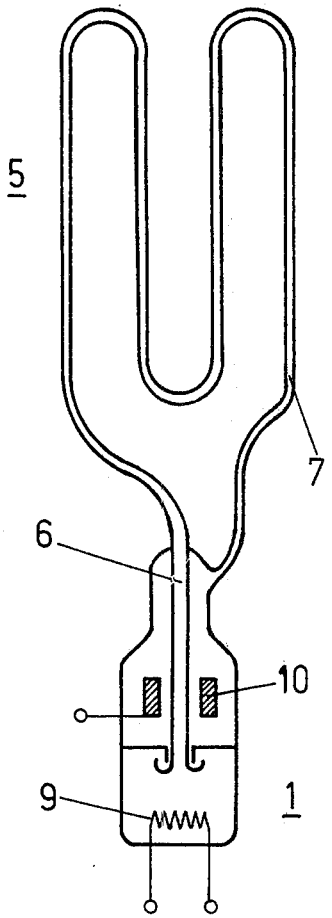
FIG. 2 shows in toto a radiation source with an envelope as in FIG. 1, but without the electrical connector and supply unit.

At their ends away from the electrodes the arms 6 and 7 are fused together so as to produce a closed, tubular, flat-meander form of discharge region 5 (FIG. 2).

Between the cathode 9 and anode 10 there is on the inner wall of the envelope 1 a collar 12 which engages with a collar 11 on the bottom end of arm 6 so as to form a connecting passage 4 which acts as a pressure-equalization region. This connecting passage 4 runs in one portion of it in the cathode 9/anode 10 direction, and in its other portion in the anode 10/cathode 9 direction. In this way there are prevented instabilities, e.g. plasma oscillations, on the one hand, and on the other, backfiring through the pressure-equalization region (cf. here Swiss patent Ges. Nr. 8456/74 or German patent P24 33 557.7).

The collar connection 11/12 divides the envelope 1 into two electrode spaces, the cathode space 2 and the anode space 3.

Between the graded seal 18 and the collar 12 the wall of envelope 1 has a Kovar-metal ring 14. (Kovar is an alloy of approximately 27% nickel, 19% cobalt and the rest iron, which has the same thermal expansion coefficient as pyrex up to the latter's softening point and therefore can make a seal with the glass). Inside on the Kovar-metal ring 14 there is attached a metallic support for the anode 10. The electrical connection for anode 10 can be provided on the outside.

The cathode 9 is situated in a hollow cylinder 13 of nickel, for example, to reduce heat radiation from the cathode. Cathode 9 itself consists, for example, of a coiled nickel lattice-ribbon with a coating of BaO, the anode 10, for example, consisting of solid molybdenum with a zirconium coating.

Figure 3:
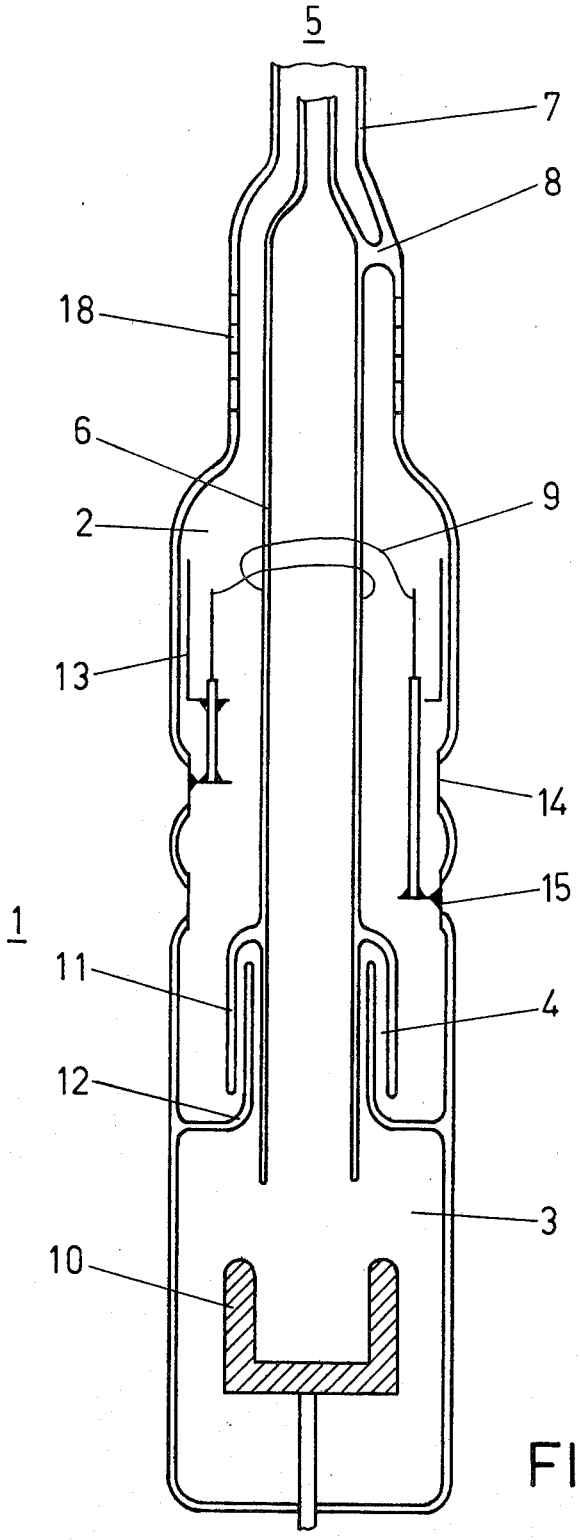
FIG. 3 shows the envelope of another radiation source conforming to the invention, with toroidal cathode, for a discharge region in the form of a cooling trap as described in Swiss patent Ges. Nr. 15836/74 or German patent P 25 01 635.7
Figure 4:
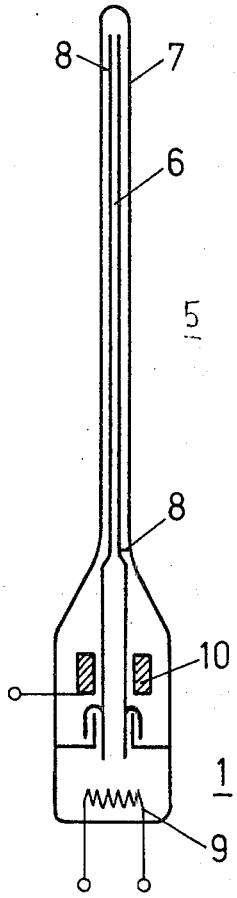
FIG. 4 shows an entire radiation source with an envelope like that in FIG. 3, again without electrical connection — and supply-unit, and with interchanged electrodes.

The basic construction of the envelope 1 of FIG. 3 is like that of FIG. 1, but here the electrodes are interchanged, the connecting passage formed by the collars is somewhat different in design and the envelope is constructed for a cooling-trap shaped discharge region 5, as is apparent from FIG. 4.

In FIG. 3 the toroidal cathode surrounds the arm 6 projecting coaxially into the envelope 1. Since the cathode 9 requires two electrical connections for heating, two Kovar-metal rings 14 and 15 are provided, one for each connection.

The connecting passage formed by the collars 11/12 is self-explanatory as represented in the drawing.

Since in the configuration of FIGS. 3 and 4 the tubular arm 6 is located coaxially inside the dead-ended tubular arm 7 of the discharge space 5, the arms 6 and 7 are joined by only one or a few supports 8 spaced over the length of the arms 6, 7 and, since there is never more than one support anywhere along this length, the gas discharge in the discharge space 5 is not obstructed.

The configuration of FIG. 1 with a discharge region 5 in the form of a double spiral with 3m of coiled tube of 10mm inner diameter was successrully operated with a 10 A discharge current. The diameter of the envelope 1 was 50 mm, its length 200 mm.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A device for producing ultraviolet radiation of high spectral radiation intensity in which the radiation is generated in a mercury-argon-filled discharge tube with a thermoemissive cathode by a wall-stabilized d.c. gas discharge at a mercury pressure $p_{Hg}$ between $5 \times 10^{-3}$ and $5 \times 10^{-1}$ torr, an argon pressure $p_{Ar}$ between 0.01 and 10 torr and a current density $j_o$ of the discharge current I between 1 and 25 A/cm$^2$, and in which the two electrode spaces are connected to one another through a pressure-equalization region as well as through the discharge region wherein the two electrodes are arranged in tandem in a common envelope, the two arms of the discharge region are joined to the end of the envelope nearest the discharge region so that one arm projects coaxially into the envelope and passes through the toroidal electrode nearest the discharge region, and the inner wall of the envelope and the arm projecting into the envelope are each provided with a collar between the two electrodes, the collars being so arranged with respect to one another as to form a connecting passage acting as a pressure-equalizin g region running between the cathode and anode spaces with a first portion running in the cathode/anode direction and a second portion running in the anode/cathode direction.

2. A device as in claim 1 wherein the envelope consists of pyrex and the two arms of the discharge region consist of fused quartz and the electrode end of the arm projecting into the envelope is fused to the electrode end of the other arm, and the latter is itself fused to the envelope by means of a graded seal.

3. A device as in claim 2 wherein the wall of the envelope between the graded seal and the collar for the pressure-equalization region has at least one Kovar-metal ring on the inner side of which the toroidal electrode is mounted.

4. A device as in claim 3 wherein the two arms of the discharge region are joined at their ends farthest from the electrodes to form a closed tube, and the discharge space is of a flat-meander form or is coiled.

5. A device as in claim 3 wherein the arm of the discharge region projecting into the envelope is a tube which is situated coaxially inside the other arm which is closed at its end farthest from the electrodes, the two arms being attached to one another by at least one support.

* * * * *